US011419191B2

(12) United States Patent
Lan et al.

(10) Patent No.: US 11,419,191 B2
(45) Date of Patent: Aug. 16, 2022

(54) SELF-ADAPTIVE ILLUMINATING DEVICE AND METHOD THEREOF

(71) Applicant: XIAMEN ECO LIGHTING CO. LTD., Xiamen (CN)

(72) Inventors: Tian Lan, Xiamen (CN); Jianxin Xie, Xiamen (CN); Liping Lin, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/822,729

(22) Filed: Mar. 18, 2020

(65) Prior Publication Data

US 2021/0298139 A1 Sep. 23, 2021

(51) Int. Cl.
*H05B 45/14* (2020.01)
*H05B 47/14* (2020.01)

(52) U.S. Cl.
CPC ..... *H05B 45/14* (2020.01); *H05B 47/14* (2020.01)

(58) Field of Classification Search
None
See application file for complete search history.

(56) References Cited

U.S. PATENT DOCUMENTS 6,418,424 B1 * 7/2002 Hoffberg ..... G06F 3/00 706/21
7,221,104 B2 * 5/2007 Lys ..... A61N 5/0618 315/291
7,973,496 B2 * 7/2011 Loef ..... H05B 45/382 315/297
8,624,513 B2 * 1/2014 Moss ..... H05B 45/20 315/193
8,716,957 B2 * 5/2014 Melanson ..... H05B 45/10 315/360
8,760,458 B2 * 6/2014 Wu ..... G09G 3/2025 345/532
8,823,289 B2 * 9/2014 Linz ..... H05B 45/24 315/309
8,866,392 B2 * 10/2014 Chen ..... G08B 15/00 315/152
8,941,316 B2 * 1/2015 King ..... H05B 45/375 315/244

(Continued)

*Primary Examiner* — Srinivas Sathiraju
(74) *Attorney, Agent, or Firm* — Chun-Ming Shih; Lanway IPR Services

(57) ABSTRACT

A self-adaptive illuminating device includes an illumination module and a driver module. The illumination module includes multiple electrically coupled illuminating units and a sampler. The sampler is electrically coupled to the illuminating units. The sampler tests at least one electrical property of the illuminating units by using a test signal for generating a feedback parameter. The driver module is electrically coupled to the illumination module. The driver module includes a signal processing unit and a power transformer. The signal processing unit is coupled to the sampler. The signal processing unit generates an operating parameter based on the feedback signal. The power transformer is electrically coupled to the signal processing unit and the illuminating units. The power transformer generates a resulting driving power based on the operating parameter and the initial driving power, and drives the illuminating units using the resulting driving power.

6 Claims, 4 Drawing Sheets

(56) References Cited

U.S. PATENT DOCUMENTS

| | | | | |
|---|---|---|---|---|
| 9,307,601 | B2 * | 4/2016 | He | H05B 45/3725 |
| 9,345,079 | B2 * | 5/2016 | Moss | H05B 45/385 |
| 10,770,916 | B2 * | 9/2020 | Chen | F21S 9/03 |
| 10,849,200 | B2 * | 11/2020 | Holec | H05B 45/14 |
| 10,856,386 | B2 * | 12/2020 | Wen | H05B 45/385 |
| 2005/0062685 | A1 * | 3/2005 | Nogawa | G09G 3/006 345/46 |
| 2007/0188427 | A1 * | 8/2007 | Lys | H05B 45/3725 345/82 |
| 2012/0242242 | A1 * | 9/2012 | Linz | H05B 45/28 315/210 |
| 2015/0002028 | A1 * | 1/2015 | Chen | H05B 45/14 315/153 |
| 2017/0019960 | A1 * | 1/2017 | Qu | H05B 45/46 |
| 2017/0271979 | A1 * | 9/2017 | McDougle | H05B 45/3725 |
| 2020/0196415 | A1 * | 6/2020 | Wen | H05B 45/325 |
| 2020/0196424 | A1 * | 6/2020 | Lin | H05B 47/14 |
| 2020/0359475 | A1 * | 11/2020 | Yang | H05B 45/325 |
| 2021/0003905 | A1 * | 1/2021 | Tolan | H05B 47/105 |

* cited by examiner

SELF-ADAPTIVE ILLUMINATING DEVICE AND METHOD THEREOF

FIELD OF THE INVENTION

The present invention relates to a self-adaptive illuminating device and a method of such illuminating device, more particularly, to an illuminating device capable of dynamically self-adjusting its electrical properties and a method of performing such self-adjustment.

BACKGROUND OF THE INVENTION

A light emitting diode (LED) is highly sensitive in its electrical properties. Also, a LED's is broadly utilized for its low power consumption, long life cycle and small maintenance. For driving a LED, a driving power, which includes at least a driving voltage and a driving current, must be precisely provided to the LED. Such that the LED can have good protection. Specifically, the LED requires matching electrical properties for its driving.

Ordinarily, a LED requires appropriate operating parameters for its constant current amplitude and target power output. Therefore, the operating parameters are required to be designed in a manner that fits the LED's operations. However, because of the nature that the LED's driving and illuminating are strictly independent from each other, it requires significantly skilled human knowledge in fabricating and installing the LED. Otherwise, the LED will not effectively prevent itself from numerous fabrication errors and/or installation errors.

SUMMARY OF THE INVENTION

The present disclosure aims at disclosing self-adaptive illuminating device and a method for self-adapting said illuminating device.

In one embodiment, the disclosed self-adaptive illuminating device includes an illumination module and a driver module. The illumination module includes a plurality of electrically coupled illuminating units and a sampler. The sampler is electrically coupled to the plurality of illuminating units. Also, the sampler tests at least one electrical property of the plurality of illuminating units by using a test signal for generating a feedback parameter. The driver module is electrically coupled to the illumination module. In addition, the driver module includes a signal processing unit and a power transformer. The signal processing unit is coupled to the sampler. Moreover, the signal processing unit receives the feedback signal and generates an operating parameter based on the feedback signal. The power transformer is electrically coupled to the signal processing unit and the plurality of illuminating units. Additionally, the power transformer receives the operating parameter from the signal processing unit, receives an initial driving power, generates a resulting driving power based on the operating parameter and the initial driving power, and drives the plurality of illuminating units using the resulting driving power.

In one example, the signal processing unit establishes an electrical property history by repeatedly testing electrical properties of the plurality of illuminating units. Also, the signal processing unit generates the test signal by referencing the electrical property history using the feedback signal as an index.

In one example, the signal processing unit forms an operating formula by statistically analyzing the electrical property history. In addition, the signal processing unit calculates the operating parameter by inputting the feedback parameter into the operating formula.

In one example, the operating formula is represented as $y=k*x$. Specifically, y indicates the calculated operating parameter, x indicates the input feedback parameter, and k indicates a ratio coefficient. Also, the signal processing unit calculates the ratio coefficient by performing a regression analysis on the electrical property history.

In one example, the operating formula is represented as $y=k*x+b$. Specifically, y indicates the calculated operating parameter, x indicates the input feedback parameter, k indicates a ratio coefficient, and b indicates a linear constant. In addition, the signal processing unit calculates both the ratio coefficient and the linear constant by performing a regression analysis on the electrical property history.

In one example, the operating formula is represented as $y=x\hat{}k$, which means y is equal to the k-th power to x. Specifically, y indicates the calculated operating parameter, x indicates the input feedback parameter, and k indicates a ratio coefficient. Moreover, the signal processing unit calculates the ratio coefficient by performing a regression analysis on the electrical property history.

In one example, the operating formula is represented as $y=k*(1/x)$. Specifically, y indicates the calculated operating parameter, x indicates the input feedback parameter, and k indicates a ratio coefficient. In addition, the signal processing unit calculates the ratio coefficient by performing a regression analysis on the electrical property history.

In one example, the test signal includes a plurality of electrical properties selected from a group consisting of a test voltage, a test current, a test pulse-width test (PWM) signal, and a test carrier signal.

In one example, the feedback parameter includes a plurality of electrical properties selected from a group consisting of a feedback voltage, a feedback current, a feedback PWM signal, and a feedback carrier signal.

In one example, the operating parameter includes a plurality of electrical properties selected from a group consisting of an operating voltage, an operating current, an operating PWM signal, and an operating carrier signal.

In one example, the plurality of illuminating units are electrically coupled in a series or parallel manner.

In one example, the sampler is electrically coupled to the plurality of electrically coupled illuminating units in a series or parallel manner.

In the disclosed method, first, at least one electrical property of a plurality of electrically-coupled illuminating units of the illuminating device is tested by using a test signal. Second, a feedback parameter is generated according to a result of testing the at least one electrical property. Third, an operating parameter is generated based on the feedback signal. Fourth, a resulting driving power is generated based on the operating parameter and an initial driving power. Last, the plurality of illuminating units are driven using the resulting driving power.

In one example, an electrical property history is established by repeatedly testing electrical properties of the plurality of illuminating units. Also, the electrical property history is referenced by using the feedback signal as an index to generate the test signal.

In one example, the electrical property history is statistically analyzed to form an operating formula. Also, the operating parameter is calculated by inputting the feedback parameter into the operating formula.

In one example, the operating formula is represented as $y=k*x$. Specifically, y indicates the calculated operating parameter, x indicates the input feedback parameter, and k indicates a ratio coefficient. Additionally, a regression analysis is performed on the electrical property history to calculate the ratio coefficient.

In one example, the operating formula is represented as y=k*x+b. Specifically, y indicates the calculated operating parameter, x indicates the input feedback parameter, k indicates a ratio coefficient, and b indicates a linear constant. Moreover, a regression analysis is performed on the electrical property history to calculate both the ratio coefficient and the linear constant.

In one example, the operating formula is represented as y=x^k, which means y is equal to the k-th power to x. Specifically, y indicates the calculated operating parameter, x indicates the input feedback parameter, and k indicates a ratio coefficient. In addition, a regression analysis is performed on the electrical property history to calculate the ratio coefficient.

In one example, the operating formula is represented as y=k*(1/x). Specifically, y indicates the calculated operating parameter, x indicates the input feedback parameter, and k indicates a ratio coefficient. Also, a regression analysis is performed on the electrical property history to calculate the ratio coefficient.

In one example, the test signal includes a plurality of electrical properties selected from a group consisting of a test voltage, a test current, a test pulse-width test (PWM) signal, and a test carrier signal.

In one example, the feedback parameter includes a plurality of electrical properties selected from a group consisting of a feedback voltage, a feedback current, a feedback PWM signal, and a feedback carrier signal.

In one example, the operating parameter includes a plurality of electrical properties selected from a group consisting of an operating voltage, an operating current, an operating PWM signal, and an operating carrier signal.

These and other objectives of the present invention will no doubt become obvious to those of ordinary skill in the art after reading the following detailed description of the preferred embodiment that is illustrated in the various figures and drawings.

DETAILED DESCRIPTION

As mentioned above, the present disclosure discloses a self-adaptive illuminating device and a method for self-adapting such illuminating device. Such that the LED can be substantially prevented from obvious amounts of fabrication errors and/or installation errors caused by independence and separation of the LED's driving and illuminating.

Figure 1:
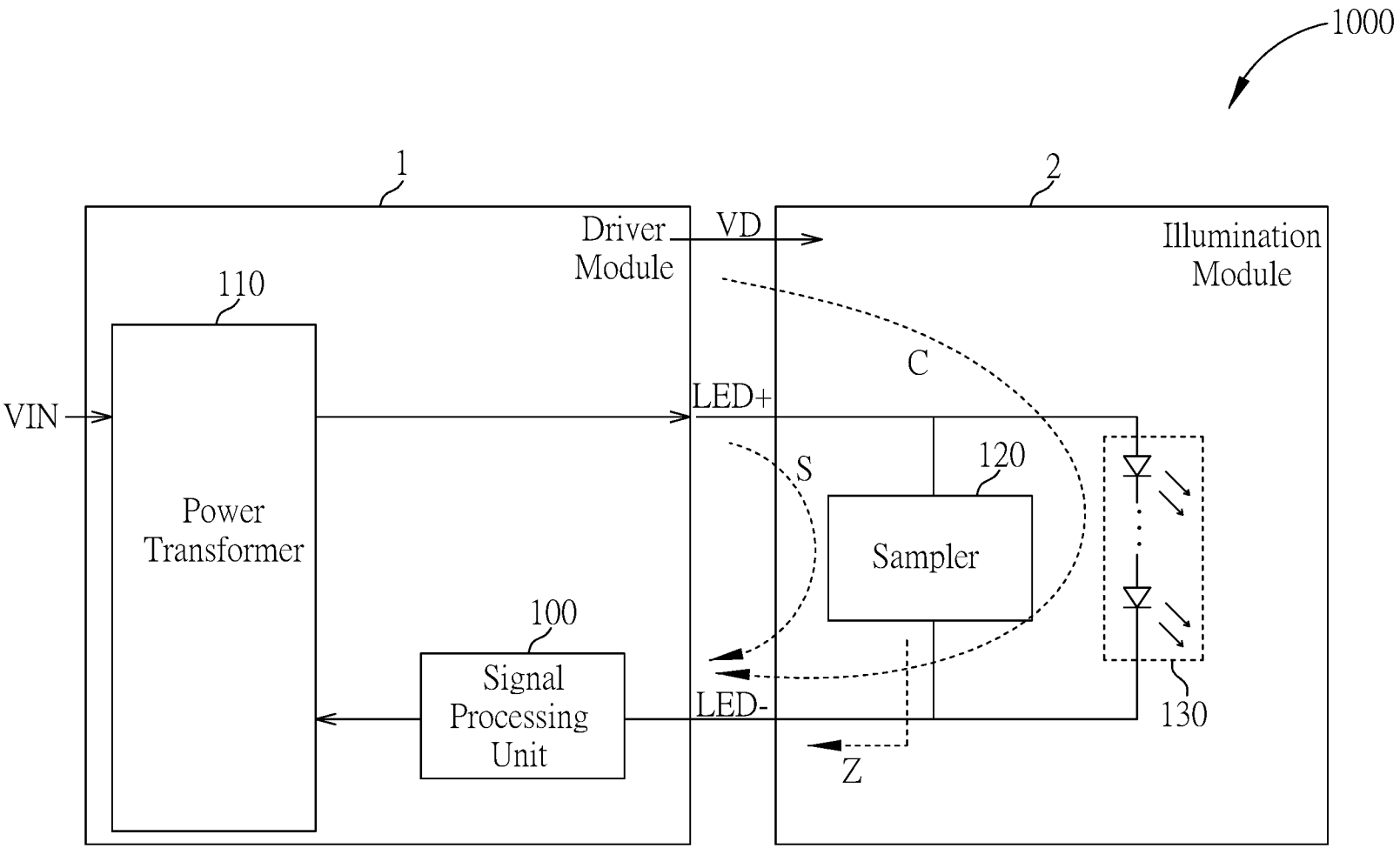
FIG. 1 illustrates an exemplary diagram of a self-adaptive illuminating device according to one embodiment.

FIG. 1 illustrates an exemplary diagram of a self-adaptive illuminating device 1000 according to one embodiment. The illuminating device 1000 includes a driver module 1 and an illumination module 2.

The illumination module 2 includes multiple electrically coupled illuminating units 130. In some examples, the illuminating units 130 are implemented using LED units. Also, the illumination module 2 includes a sampler 120. Specifically, the sampler 120 is electrically coupled to the illuminating units 130. For test purposes, the sampler 120 tests at least one electrical property of the multiple illuminating units 130 by using a test signal. Also, the sampler 120 generates a feedback parameter Z that corresponds to a result of testing the illuminating units 130.

The driver module 1 is electrically coupled to the illumination module 2. In addition, the driver module 1 includes a signal processing unit 100 and a power transformer 110.

The signal processing unit 100 is coupled to the sampler 120. Therefore, the signal processing unit 100 receives the feedback signal Z from the sampler 120. Also, the signal processing unit 100 generates an operating parameter C based on the feedback signal Z. Specifically, the signal processing unit 100 aims at fitting current electrical properties of the illuminating units 130 that can be referred from the feedback signal Z.

The power transformer 110 is electrically coupled to the signal processing unit 100 for receiving the operating parameter C. Also, the power transformer 110 receives an input driving power VIN. Such that the power transformer 110 generates a resulting power VD based on both the operating parameter C and the input driving power VIN. Last, the power transformer 110 drives the illuminating units 130 using the resulting driving power VD.

Additionally, along with the resulting driving power VD, the sampler 120 initiates a new feedback cycle by sampling at least one electrical property of the illuminating units 130 that is generated in response to the resulting driving power VD. In this way, the illuminating device 1000 is capable of repeatedly sampling and self-adapting itself for meeting the illuminating units 130's electrical properties. Moreover, the illuminating device 1000 substantially minimizes fabrication errors and/or installation errors caused by independence between the LED's driving and illuminating. As a result, the illuminating device 1000 substantially minimizes required human efforts in dealing with such fabrication errors and/or installation errors.

In some examples, before the illuminating device 1000 actually starts working, the signal processing unit 100 establishes an electrical property history for the illuminating units 130 in advance. With the aid of the electrical property history, the signal processing unit 100 has a strong reference to adjust the resulting driving power VD in response to the feedback signal Z. Specifically, the signal processing unit 100 has a storage (e.g., a memory) to store the electrical property history for immediate reference, including values of and associations between the feedback signal Z and the calculated operating parameters C.

For establishing the electrical property history, the signal processing unit initiates the sampler 120, for example, using a test signal S. Such that the sampler 120 begins sampling (i.e., testing) the illuminating units 130's at least one electrical property. In some examples, the signal processing unit 100 performs a statistical analysis (e.g. a regression analysis) on sampled data collected from the feedback signal Z for several cycles. Therefore, the signal processing unit 100 establishes a reference table (i.e., an operating formula acting as an association between the feedback signal Z and the operating parameters C) that can respond to various types of feedbacked electrical properties (i.e. indexes) to form appropriate operating parameters C. Specifically, the reference table.

In a first example, the operating formula is represented as y=k*x. Specifically, y indicates the calculated operating parameter, x indicates the input feedback parameter (i.e., the index), and k indicates a ratio coefficient. Also, the signal processing unit 100 calculates the ratio coefficient k by performing a statistical analysis on the electrical property history as mentioned above.

Similarly, in a second example, the operating formula is represented as y=k*x+b. Specifically, y indicates the calculated operating parameter, x indicates the input feedback parameter, k indicates a ratio coefficient, and b indicates a linear constant. Additionally, the signal processing unit 100 calculates both the ratio coefficient k and the linear constant b by performing a statistical analysis on the electrical property history.

In a third example, the operating formula is represented as y=x^k. That is, y is equal to the k-th power to x. And specifically, y indicates the calculated operating parameter, x indicates the input feedback parameter, and k indicates a ratio coefficient. Moreover, the signal processing unit 100 calculates the ratio coefficient k by performing a statistical analysis on the electrical property history.

In a fourth example, the operating formula is represented as y=k*(1/x). Specifically, y indicates the calculated operating parameter, x indicates the input feedback parameter, and k indicates a ratio coefficient. In addition, the signal processing unit 100 calculates the ratio coefficient k by performing a statistical analysis on the electrical property history.

In some examples, the abovementioned ratio coefficient k and/or the linear constant b are pre-determined or assigned for meeting known requirements of the illuminating units 130.

In some examples, the initiated test signal S may refer to at least one electrical property, such as a test voltage, a test current, a test pulse-width test (PWM) signal, and/or a test carrier signal.

In some examples, the feedback parameter Z may refer to at least one electrical property. For example, a feedback voltage, a feedback current, a feedback PWM signal, and/or a feedback carrier signal.

In some examples, the operating parameter C may refer to, exemplarily, an operating voltage, an operating current, an operating PWM signal, and/or an operating carrier signal.

In some examples, the illuminating units 130 are electrically coupled to each other in a series manner. And the sampler 120 is also correspondingly and electrically coupled to the illuminating units 130 in a series manner.

Similarly, in some other examples, the illuminating units 130 are electrically coupled to each other in a parallel manner. Therefore, the sampler 120 is correspondingly and electrically coupled to the illuminating units 130 in a parallel manner.

Figure 2:
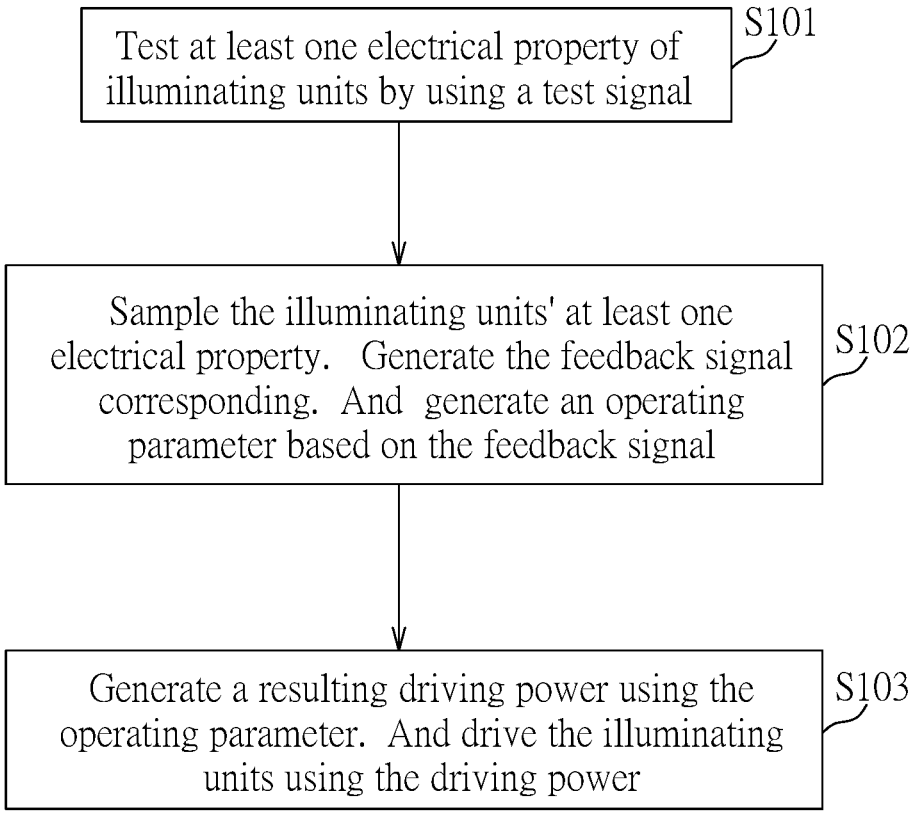
FIG. 2 illustrates a schematic flowchart for a self-adaptive method performed on the self-adaptive illuminating device shown in FIG. 1 according to one embodiment.

In some examples, the self-adaptive illumination device 1000 performs a self-adapting method. FIG. 2 illustrates a schematic flowchart for such method according to one embodiment.

In Step S101, the signal processing unit 100 tests at least one electrical property of the illuminating units 130 by using the test signal S. Such that the illuminating device 1000's test procedure starts working.

In Step S102, the sampler 120 receives the test signal S, in turn samples the illuminating units 130's at least one electrical property and generates the feedback signal Z for representing the sampled at least one electrical property. Also, the signal processing unit 100 receives the feedback signal Z from the sampler 120, and generates the operating parameter C based on the feedback signal Z. In some examples, the signal processing unit 100 generates the operating parameter C by referencing the above mentioned operating formula and using the feedback signal Z as an index.

In Step S103, the power transformer 110 receives both the operating parameter C and an external initial driving power. In turn, the power transformer 110 generates a resulting driving power VD and also drives the illuminating units 130 with the aid of the driving power VD.

FIG. 2 indicates a cycle of self-adapting the illuminating device 1000's electrical properties. And the illuminating device 1000 can maintain its self-adaption by repeatedly running the steps shown in FIG. 2 in cycles.

Figure 3:
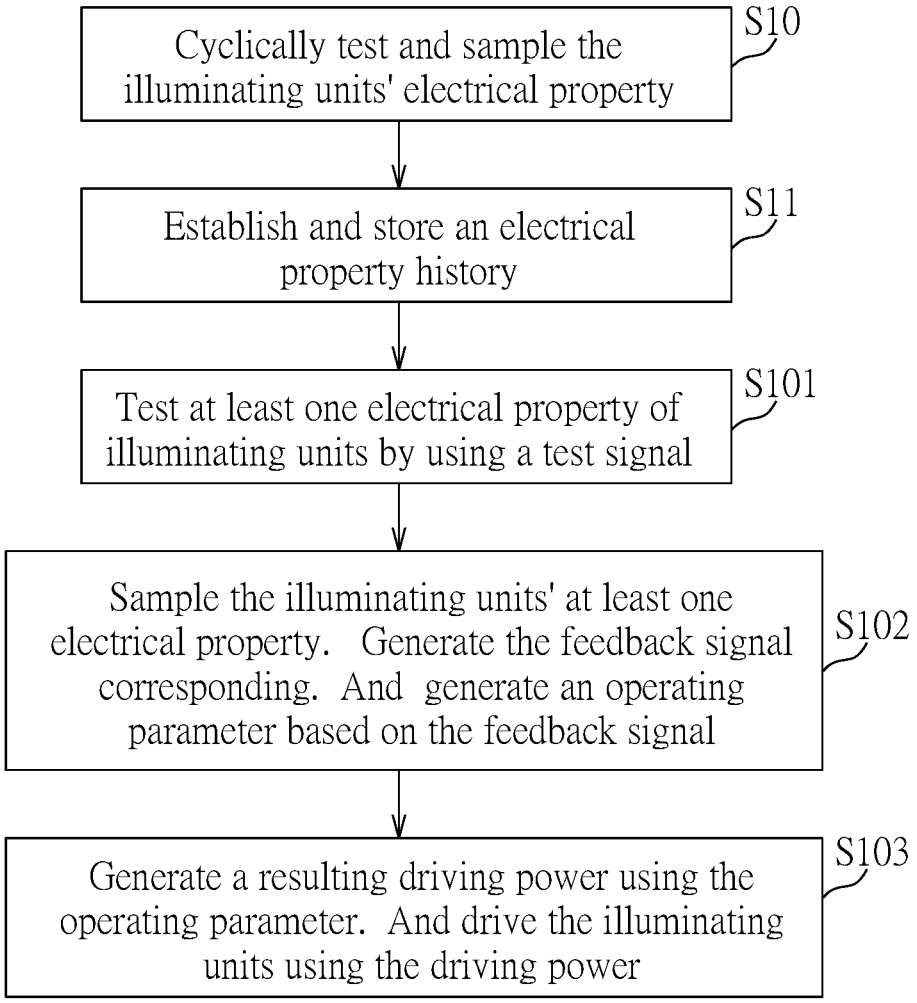
FIG. 3 illustrates a flowchart of a pre-establishment on the electrical property history of the illuminating device shown in FIG. 1, which is built based on top of the steps shown in FIG. 2, according to one example.

In another examples, the steps shown in FIG. 2 may further involve a procedure of pre-establishing the electrical property history that will then be stored in the signal processing unit 100. FIG. 3 illustrates the pre-establishment of the illuminating device 1000's electrical property history on top of the steps shown in FIG. 2.

In Step S10, the signal processing unit 100 repeatedly initiates tests (e.g. by issuing the test signal S). In response, the sampler 120 samples the illuminating units 130's electrical properties in cycles.

In Step S11, the signal processing unit 100 establishes the electrical property history based on the feedback signal Z as an index. Such that the signal processing unit 100 cyclically generates an operating parameter C that corresponds the feedback signal Z. In addition, the signal processing unit 100 establishes associations between the feedback signal Z and its corresponding operating parameter C in the electrically property history. Also, the signal processing unit 100 stores the electrical property history in a memory, which may be a built-in storage of the signal processing unit 100.

Figure 4:
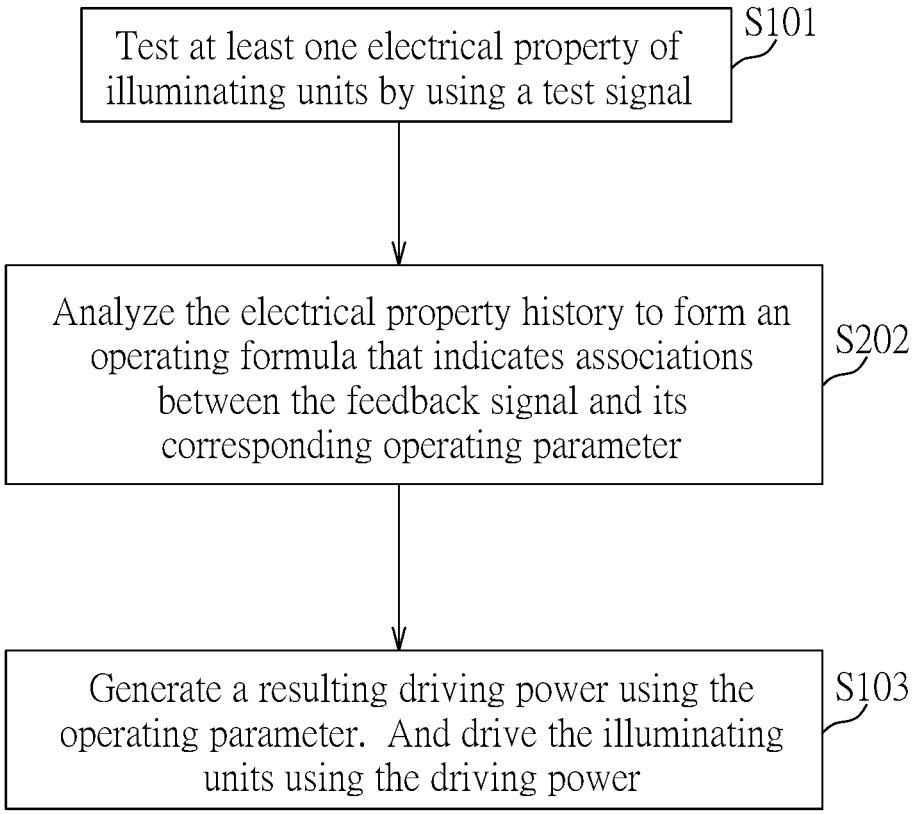
FIG. 4 illustrates a flowchart of utilizing an operating formula for driving the self-adaptive illumination device shown in FIG. 1, which is built based on top of the steps shown in FIG. 2, according to one example.

In one example, the step S102 shown in FIG. 2 is optionally replaced by utilizing an operating formula to simulate the electrical property history, as shown in FIG. 4. Specifically, in some examples, the signal processing unit 100 statistically analyzing the electrical property history to form the operating formula, such as calculating a ratio coefficient and/or a linear constant of the operating formula. Details of forming the operating formula have been exemplified above, such that repeated descriptions are skipped for brevity.

In some examples, the sampler 120 samples the illuminating units 130's electrical properties by testing their resistive and/or capacitive responses.

Also, the sampler 120 is disposed in the illumination module 2 in a manner that the sampler 120's probing on the illuminating units 130 is substantially free from disturbing the illuminating units 130's operations. For example, by adequately coupling the sampler 120 to the illuminating units 130 in a parallel or series manner. In some examples, the input driving power VIN received by the power transformer 110 an alternative-current power source, for example, of 220 volts, or other types of power sources. Such that the resulting driving power VD acts as a stable direct-current power source.

In some examples, the signal processing unit 100 includes a central processing unit, a memory and a program, all of which can be implemented using standard elements that acquire same or similar functions. The program is stored in the memory and is capable of implementing the abovementioned self-adapting method. Also, the central processing unit is capable of executing the program for implemented abovementioned self-adapting method to drive the illuminating units 130. In some examples, the central processing unit can be implemented using a general purpose processor, a digital signal processor (DSP), an application specific integrated circuit (ASIC), a field-programmable gate array (FPGA) or other programmable logic components, distributed gate elements, transistor logic components, or distributed hardware components. Also, the general purpose processor can be implemented using a microprocessor or a regular processor. In some examples, the memory can be of built-in type or of externally-coupled type, such as a plug-in hard-drive, a smart media card (SMC), a secure digital (SD) card, a flash card.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A self-adaptive illuminating device, comprising:

an illumination module, comprising:

a plurality of electrically coupled illuminating units; and a sampler, electrically coupled to the plurality of illuminating units, and configured to test at least one electrical property of the plurality of illuminating units by using a test signal for generating a feedback parameter; and a driver module electrically coupled to the illumination module, comprising:

a signal processing unit, coupled to the sampler, and configured to receive the feedback signal and generate an operating parameter based on the feedback signal; and a power transformer, electrically coupled to the signal processing unit and the plurality of illuminating units, and configured to receive the operating parameter from the signal processing unit, receive an initial driving power, generate a resulting driving power based on the operating parameter and the initial driving power, and drive the plurality of illuminating units using the resulting driving power, wherein the signal processing unit is further configured to establish an electrical property history by repeatedly testing electrical properties of the plurality of illuminating units in the self-adaptive illuminating device, and further configured to reference the electrical property history using the feedback signal as an index for generating a corresponding operating parameter, wherein the signal processing unit is further configured to form an operating formula by statistically analyzing the electrical property history, and further configured to calculate the operating parameter by inputting the feedback parameter into the operating formula, wherein the operating formula is represented as $y=k*x$;

wherein y indicates the calculated operating parameter, x indicates the input feedback parameter, and k indicates a ratio coefficient; and wherein the signal processing unit is further configured to calculate the ratio coefficient by performing a statistical analysis on the electrical property history.

2. The self-adaptive illuminating device of claim 1, wherein the test signal comprises a plurality of electrical properties selected from a group consisting of a test voltage, a test current, a test pulse-width test (PWM) signal, and a test carrier signal.

3. The self-adaptive illuminating device of claim 1, wherein the feedback parameter comprises a plurality of electrical properties selected from a group consisting of a feedback voltage, a feedback current, a feedback PWM signal, and a feedback carrier signal.

4. The self-adaptive illuminating device of claim 1, wherein the operating parameter comprises a plurality of electrical properties selected from a group consisting of an operating voltage, an operating current, an operating PWM signal, and an operating carrier signal.

5. The self-adaptive illuminating device of claim 1, wherein the plurality of illuminating units are electrically coupled in a series or parallel manner.

6. The self-adaptive illuminating device of claim 1, wherein the sampler is electrically coupled to the plurality of electrically coupled illuminating units in a series or parallel manner.

* * * * *